US007232965B2

(12) United States Patent
Gibbons et al.

(10) Patent No.: US 7,232,965 B2
(45) Date of Patent: Jun. 19, 2007

(54) LINEAR MOTION COMPENSATOR

(75) Inventors: Donald G. Gibbons, Wake Forest, NC (US); Jon H. Hanson, Raleigh, NC (US)

(73) Assignee: Square D Company, Palatine, IL (US)

( * ) Notice: Subject to any disclaimer, the term of this patent is extended or adjusted under 35 U.S.C. 154(b) by 159 days.

(21) Appl. No.: 10/804,509

(22) Filed: Mar. 19, 2004

(65) Prior Publication Data

US 2005/0205397 A1 Sep. 22, 2005

(51) Int. Cl.
*H01H 21/54* (2006.01)

(52) U.S. Cl. ..... 200/17 R; 200/520; 200/537; 200/341

(58) Field of Classification Search ..... 200/17 R, 200/520, 537, 549, 243, 246, 250–252, 341
See application file for complete search history.

(56) References Cited

U.S. PATENT DOCUMENTS 4,866,222 A * 9/1989 Clark et al. ..... 200/16 E
5,964,342 A * 10/1999 Wecke et al. ..... 200/534
6,198,058 B1 * 3/2001 Graninger et al. ..... 200/50.02
6,483,058 B2 * 11/2002 Ehrensberger ..... 200/302.2
6,486,418 B1 * 11/2002 Jorczak ..... 200/17 R
6,548,774 B1 * 4/2003 Bachle ..... 200/61.7
6,693,248 B1 * 2/2004 Schultz ..... 200/11 TC

FOREIGN PATENT DOCUMENTS

DE 3809144 A1 9/1989
WO WO 11/10183 A 2/2000

* cited by examiner

*Primary Examiner*—K. Lee

(57) ABSTRACT

An linear motion compensator for translating a particular amount of linear movement produced by an input device into a particular amount of linear movement required to properly operate an output device, without causing damage to either the input device or the output device.

20 Claims, 10 Drawing Sheets

LINEAR MOTION COMPENSATOR

CROSS-REFERENCE TO RELATED PATENTS

Not applicable

STATEMENT REGARDING FEDERALLY SPONSORED RESEARCH OR DEVELOPMENT

Not applicable

FIELD OF THE INVENTION

The present invention relates to operator interface devices, and particularly to a linear motion compensator for use with operator interface devices and electrical switching devices that have different linear operating strokes.

BRIEF DESCRIPTION OF THE DRAWINGS

The features of the invention will become more clearly understood from the following detailed description of the invention read together with the drawings in which.

Figure 1:
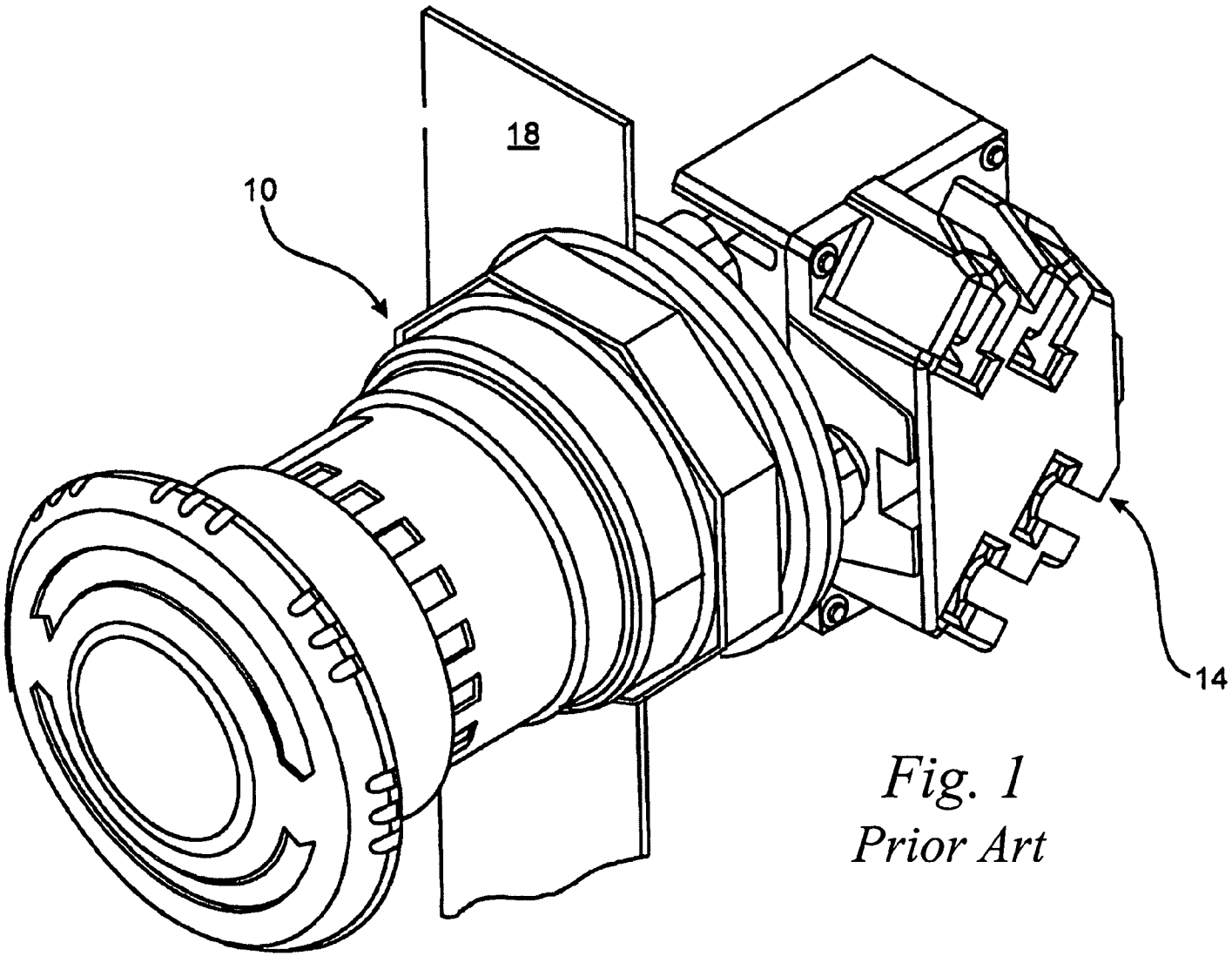
Fig. 1 Prior Art
FIG. 1 illustrate a typical operator interface and contact module assembly of the prior art.

Before one embodiment of the invention is explained in detail, it is to be understood that the invention is not limited in its application to the details of construction described herein or as illustrated in the drawings. The invention is capable of other embodiments and of being practiced or being carried out in various other ways. Further, it is to be understood that the phraseology and terminology used herein is for the purpose of description and should not be regarded as limiting.

DETAILED DESCRIPTION OF THE DRAWINGS

FIG. 1 illustrates a typical configuration wherein an input device 10, such as an operator interface device, is assembled to an output device 14, such as an electrical switching device or contact module, in a control panel, switchboard or similar equipment 18. For operational simplicity, the input device

10, as shown in FIG. 1, is a simple linear movement device, such as pushbutton operator. However, for the purpose of the present invention, the input device 10 can be any input device capable of producing a linear movement or displacement, such as a rotary or lever operator that incorporates a means, such as a cam, to translate the rotary or lever movement into a linear movement. Also for operational simplicity, the output device 14, as shown in FIG. 1, is a simple contact module.

Figure 2A:
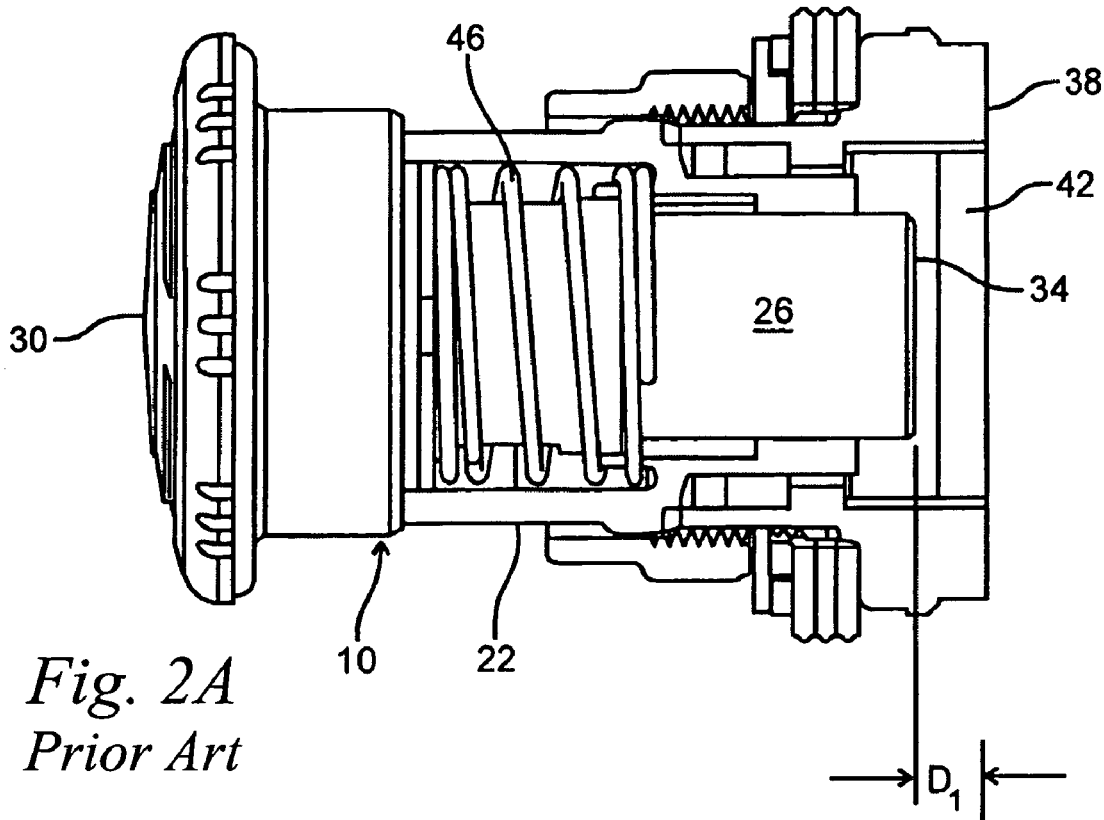
Fig. 2A Prior Art
FIGS. 2A and 2B illustrate in cross-section the operator interface device of FIG. 1.
Figure 2B:
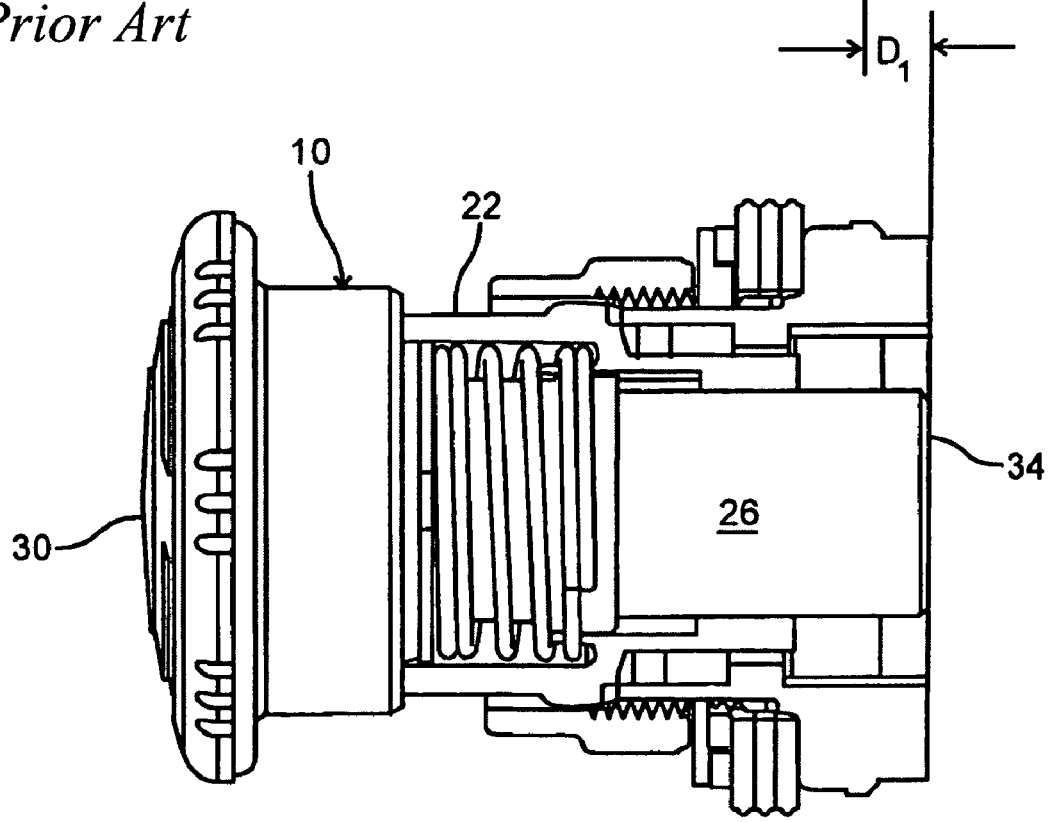
Fig. 2B Prior Art

FIGS. 2A and 2B illustrate the two basic operating conditions of the input device 10, of FIG. 1. It is to be understood that more complex input devices, such as rotary operators or multiple button operators, can have more than two operating conditions. The input device 10 typically includes a housing assembly 22 that can be constructed from one or more parts. The housing 22 substantially encloses and slidably supports an operating shaft 26, having an input end 30 for receiving an external input and an output end 34 for transmitting the received external input to the output device 14. The housing assembly 22 defines an output end 38, which includes means (not shown) for attaching to the output device 14, and an aperture 42 through which a linear movement of the shaft 26 can be transferred to the output device 14. The operating shaft 26 is normally biased to a first or normal position, as shown in FIG. 2A, by means of a spring 46 or similar biasing device. In response to the external input, the operating shaft 26 moves linearly within the housing assembly 22, to a second or activated position adjacent the output end 38, as shown in FIG. 2B. When the input device 10 is in the second (activated) position, the output end 38 of the operating shaft 26 will have moved a particular linear distance or stroke $D_1$ from its first position. Typically the stroke $D_1$ is fixed by the internal construction of the input device 10 and can not be altered. In a typical pushbutton device, the operating shaft 26 normally returns to its first position as soon as the external input is removed. However, some input devices 10 have a latching feature that is activated when the operating shaft 26 is moved into its second position. This latching feature maintains the operating shaft 26 in its second position until some particular manipulation of the input device 10 releases the latch and allows the operating shaft 26 to return to its first position. Therefore, proper operation of such input devices 10 requires that the output end 34 of the operating shaft 26 be capable of moving the full particular linear distance $D_1$.

Figure 3A:
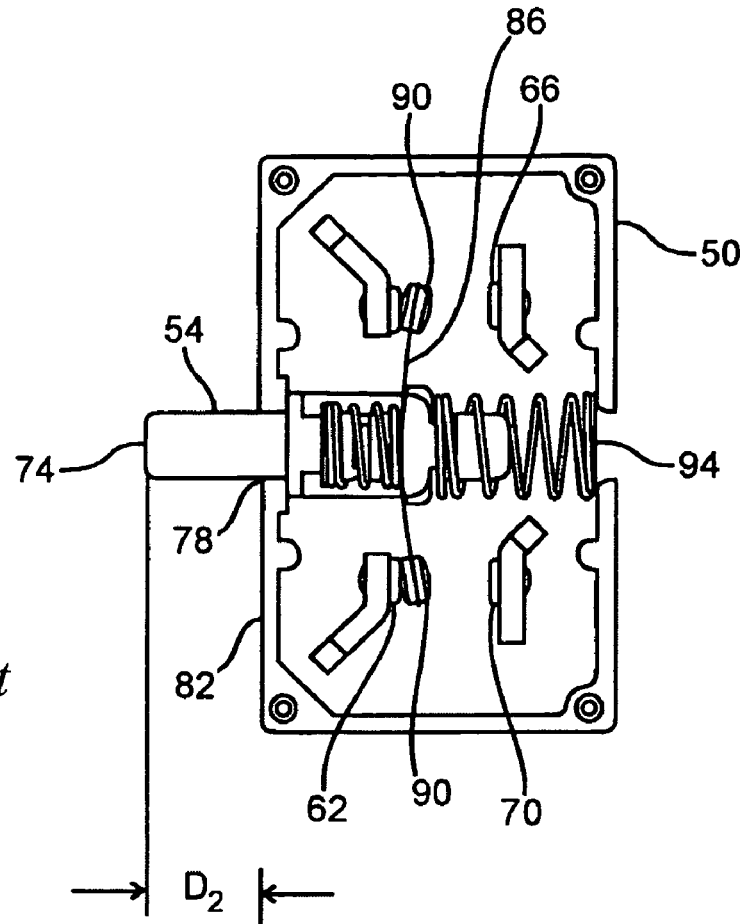
Fig. 3A Prior Art
FIGS. 3A, 3B and 3C illustrate in cross-section the normal operating conditions of the contact module of FIG. 1.
Figure 3B:
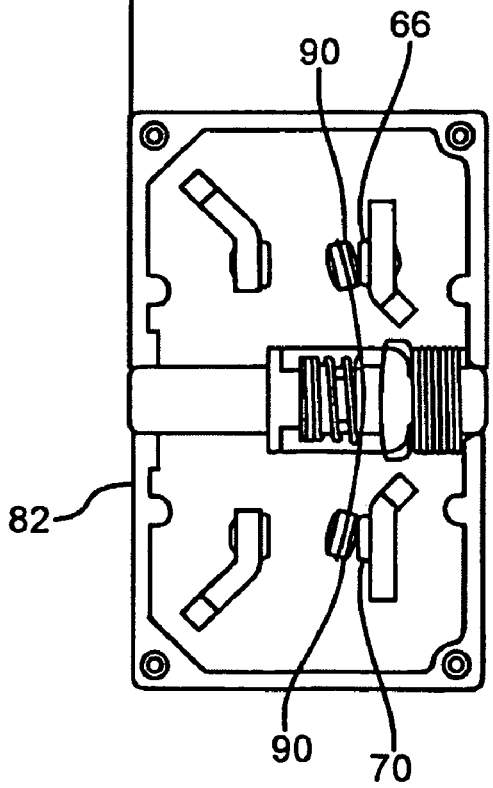
Fig. 3B Prior Art
Figure 3C:
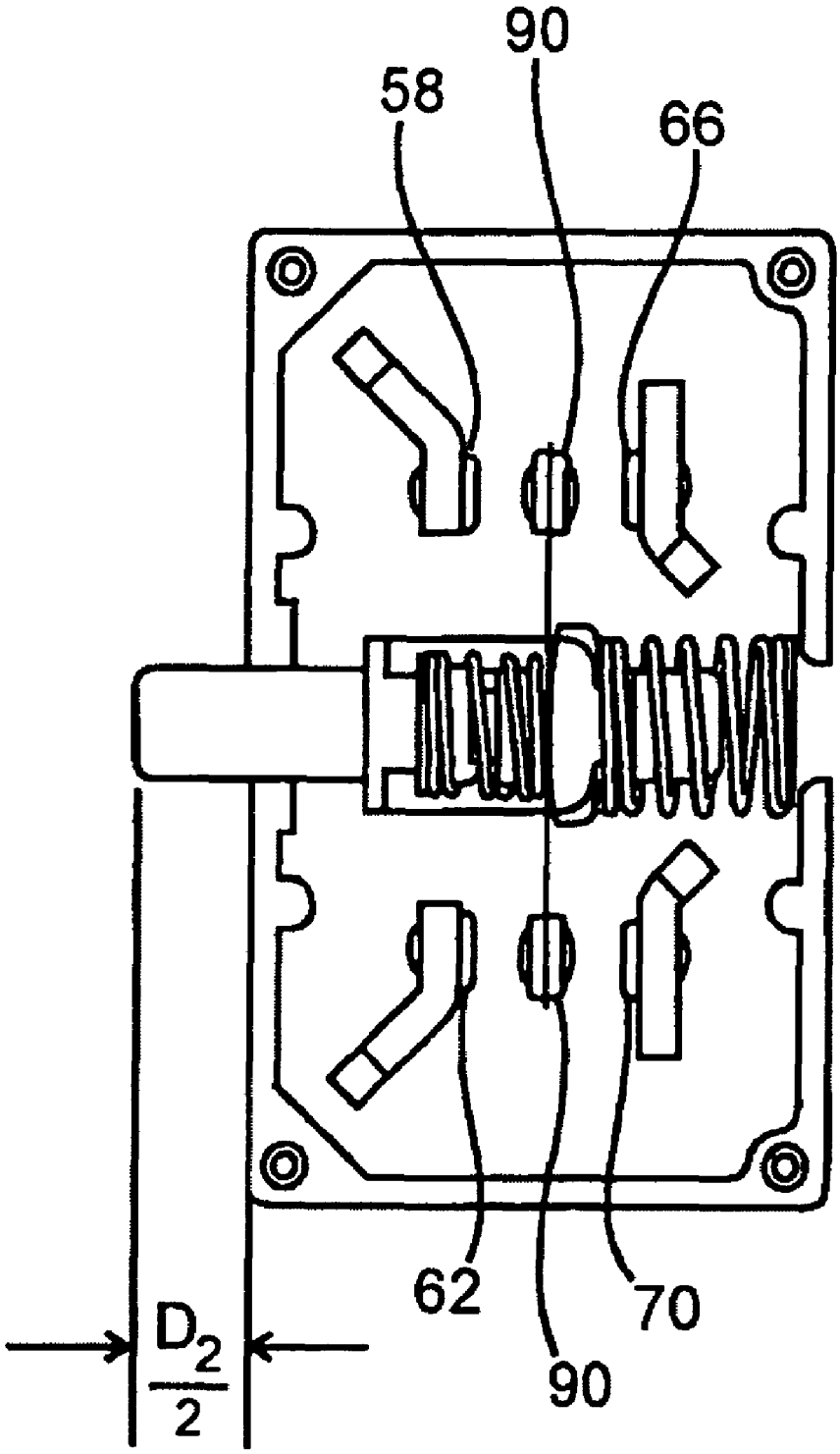
Fig. 3C Prior Art

FIGS. 3A, 3B and 3C illustrate the three basic operating conditions of the output device 14 of FIG. 1. The output device 14, a contact module, includes a housing assembly 50, which partially encloses and supports a linearly movable operating shaft 54, a first pair of stationary electrical contacts 58 and 62 and a second pair of stationary electrical contacts 66 and 70. The operating shaft 54 has an operating end 74, which extends outwardly from the housing assembly 50 through an aperture 78 defined in a first end 82 of the housing assembly 50. The first end 82 is configured for attachment to the operating end 38 of the input device 10, such that the operating end 74 of operating shaft 54 can engage the operating end 34 of the input device operating shaft 26, through the aperture 42. The operating shaft 54 supports an electrically conductive bridge 86 having a pair of bridging contacts 90 at each end. In the first operating condition, the operating shaft 54 and its operating end 74 are normally biased to a first position, as shown in FIG. 3A, by a spring 94, or similar biasing device. In this first position, the bridging contacts 90 engage the first pair of stationary contacts, 58 and 62, thereby completing an electrical path between the first pair of stationary contacts, 58 and 62, and defining them as normally closed (NC) contacts. The second pair of stationary contacts, 66 and 70, are not engaged by the bridging contacts 90 and are therefore normally open (NO) contacts. The biasing means 94 provides sufficient force to slightly bow the bridge 86, thereby ensuring a good electrical connection between the bridging contacts 90 and first pair of stationary contacts 58 and 62. In the second operating condition, as shown in FIG. 3B, the operating end 74 of operating shaft 54 has been displaced from its first position, by a particular linear distance or stroke $D_2$, to a second position adjacent to, or coincident with, the first end 82 of housing assembly 50. In this second position, the bridging contacts 90 have disengaged from the first pair of stationary contacts, 58 and 62, thereby opening the electrical path between them and have engaged the second pair of stationary contacts, 66 and 70, thereby completing an electrical path between them. The displacement of the operating shaft 54 by the particular linear distance $D_2$ provides sufficient force to slightly bow the bridge 86, thereby ensuring a good electrical connection between the bridging contacts 90 and second pair of stationary contacts 66 and 70. In the third operating condition, the operating end 74 of the operating shaft 54 has been displaced approximately one half of the stroke $D_2$ (shown as $D_2/2$). Therefore, neither of the first or second pairs of stationary contacts, 58 and 62 or 66 and 70, respectively, has a completed electrical path. This condition is not usually provided by simple pushbutton type input devices 10, but is commonly supported by rotary operable input devices 10. From the description of these operations it can be seen that the stroke $D_1$ of the input device 10 must be equal, within operating tolerances, to the stroke $D_2$ of the output device 14 for proper operation of both devices. This is generally not a problem when input devices 10 and output devices 14 are selected from the same product line, series or manufacturer. However, situations can arise when it is either necessary or desirable to mate an input device 10 from one product line, series or manufacturer with an output device 14 from another product line, series or manufacturer.

Figure 4A:
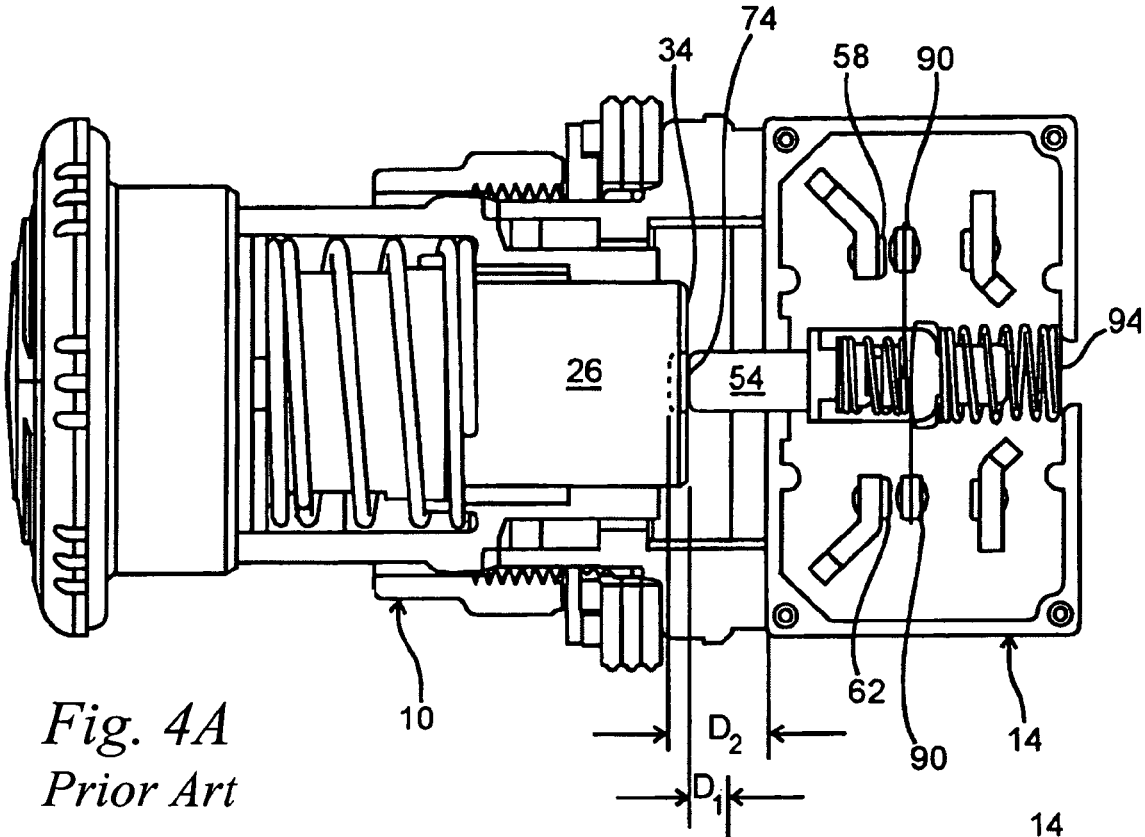
Fig. 4A Prior Art
FIGS. 4A and 4B illustrate in cross-section abnormal operating conditions of the contact block of FIG. 3 when the operating stroke of the input device does not match the operating stroke of the contact module.
Figure 4B:
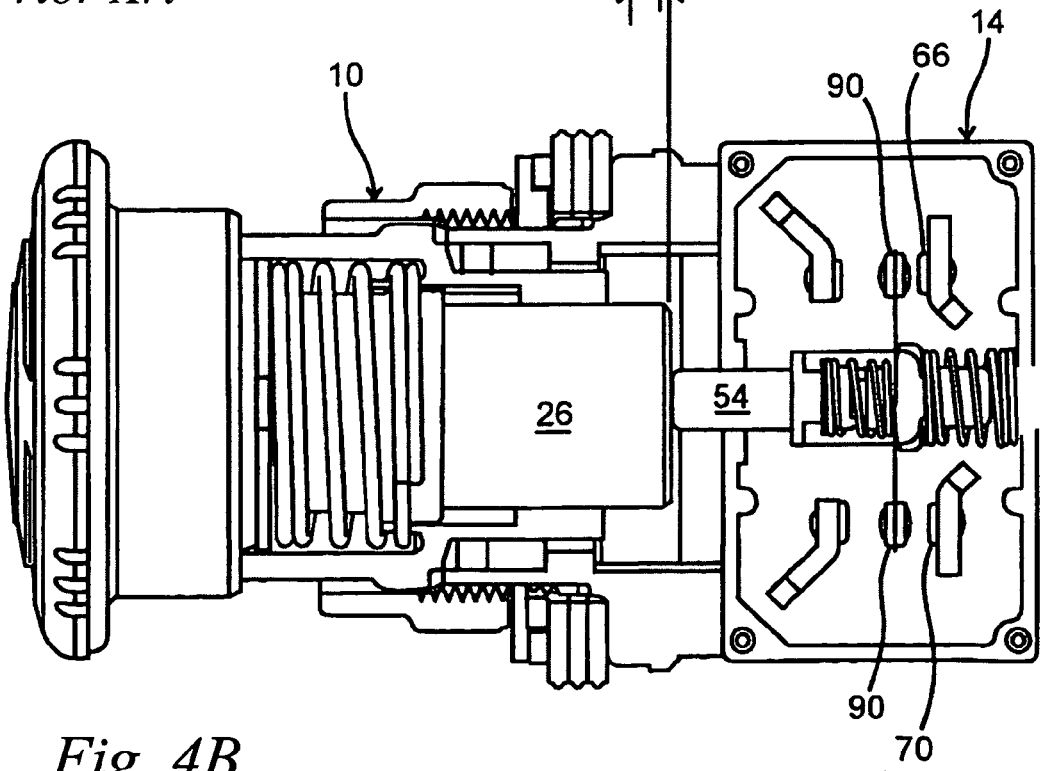
Fig. 4B Prior Art

FIGS. 4A and 4B illustrate two of a number of situations which can occur when the operating parts of an input device 10 are not compatible with the operating parts of the output device 14 to which it will be attached. The illustrated conditions will be used in explaining the operation of the invention. As shown in FIGS. 4A and 4B, the operating end 34 of the input device operating shaft 26 is not properly position to engage the operating end 74 of the output device operating shaft 54, when both devices are in the first or normal position and the stroke $D_1$ of the input device operating shaft 26 is less than the stroke $D_2$ of the output device operating shaft 54. In this example, the operating end 34 of shaft 26 is positioned to close to the operating end 38 of housing assembly 22. Therefore, the operating shaft 54 of the output device 14 is partially depressed and can not be moved to its first position (shown in dashed lines) by biasing spring 94. This condition does not permit the bridging contacts 90 to engage the first pair of stationary contacts, 58 and 62, when the input device 10 is in its first position. Further, since stroke $D_1$ is less than stroke $D_2$, the input device 10 can not properly place the operating shaft 54 of the output device 14 in its second or activated position, as shown in FIG. 4B. However, these conditions and others can be corrected by placing a stroke compensator, as disclosed herein, between the input device 10 and output device 14.

Figure 5:
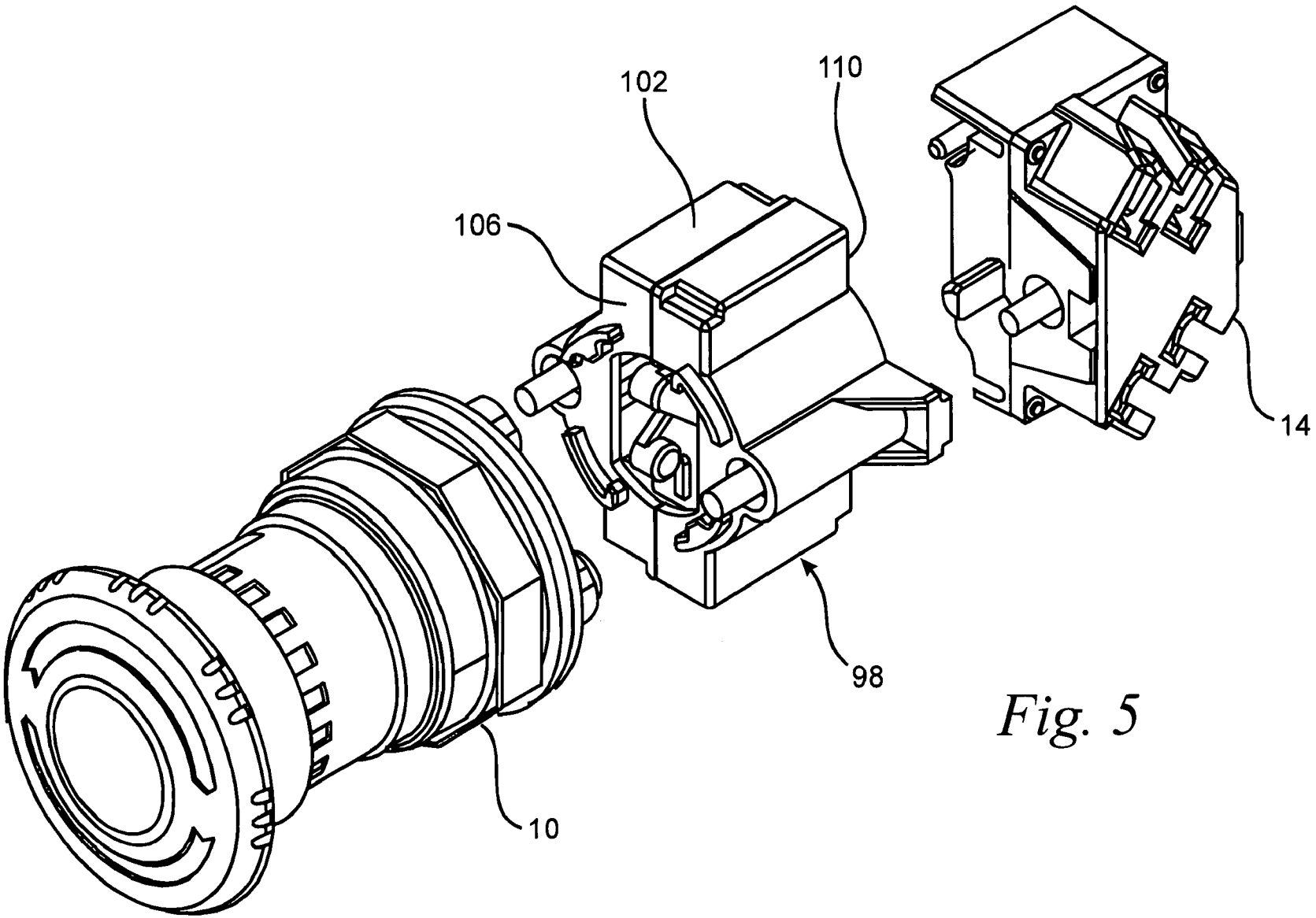
FIG. 5 illustrates in exploded view, the operator interface device and output device of FIG. 1 with a stroke compensator manufactured in accordance with the present invention.

FIG. 5 illustrates an exploded view of the input device 10, output device 14 and one embodiment of a stroke compensator 98, manufactured in accordance with the present invention, intermediate the input and output devices, 10 and 14, respectively. The stroke compensator 98 includes a housing 102 which has a first end 106 adapted for connecting to the input device 10 and a second end 110 adapted for connecting to the output device 14.

Figures 6A, 6B:
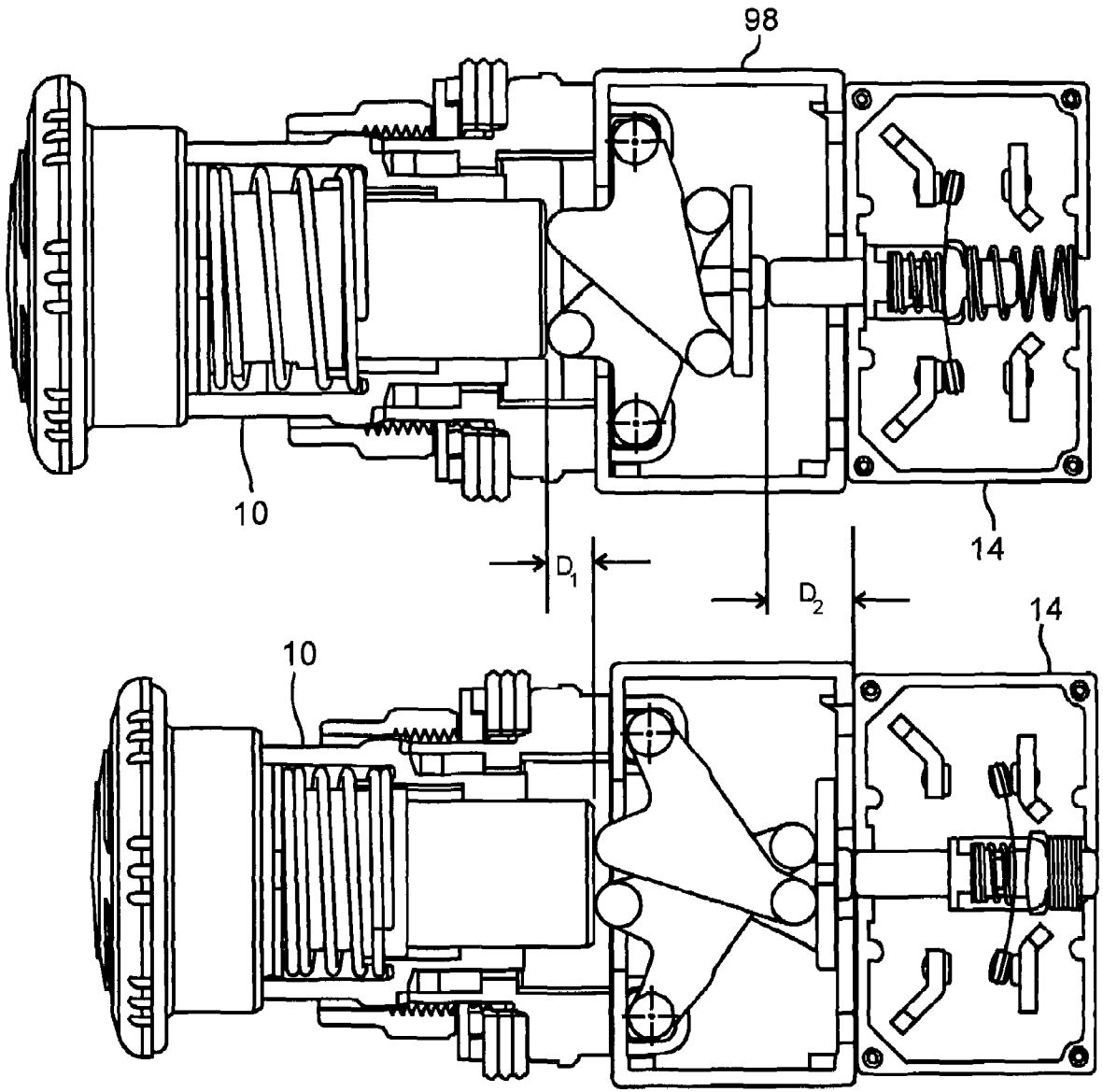
FIGS. 6A and 6B, illustrate in a cutaway view, a stroke compensator of the present invention installed between a typical operator interface device and a typical contact module.

FIGS. 6A and 6B, illustrate in cross-section, the assembled input device 10, stroke compensator 98 and output device 14 of FIG. 5.

Figure 7:
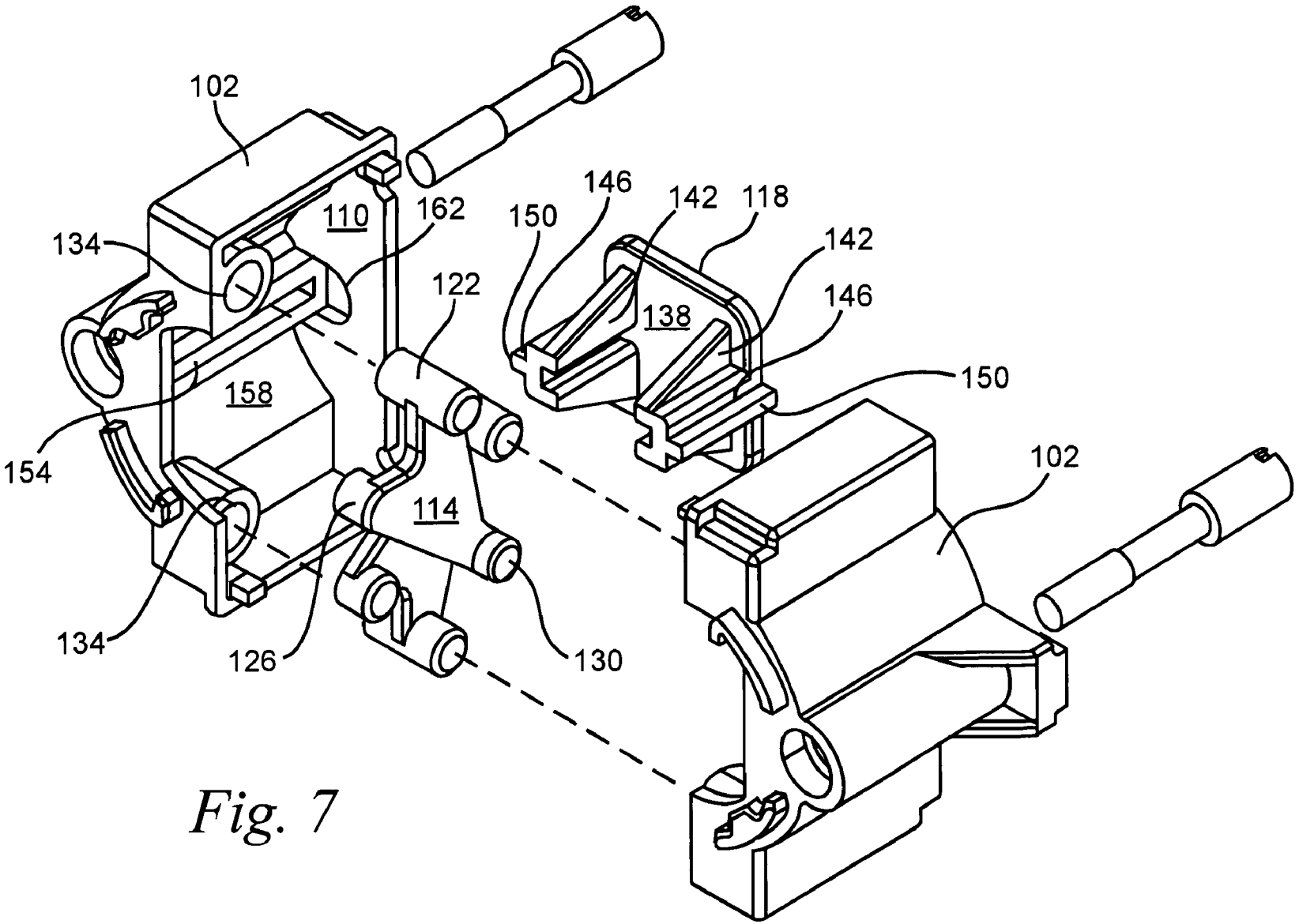
FIG. 7 illustrates an exploded view of one embodiment of a stroke compensator manufactured in accordance with the present invention.
Figure 8A:
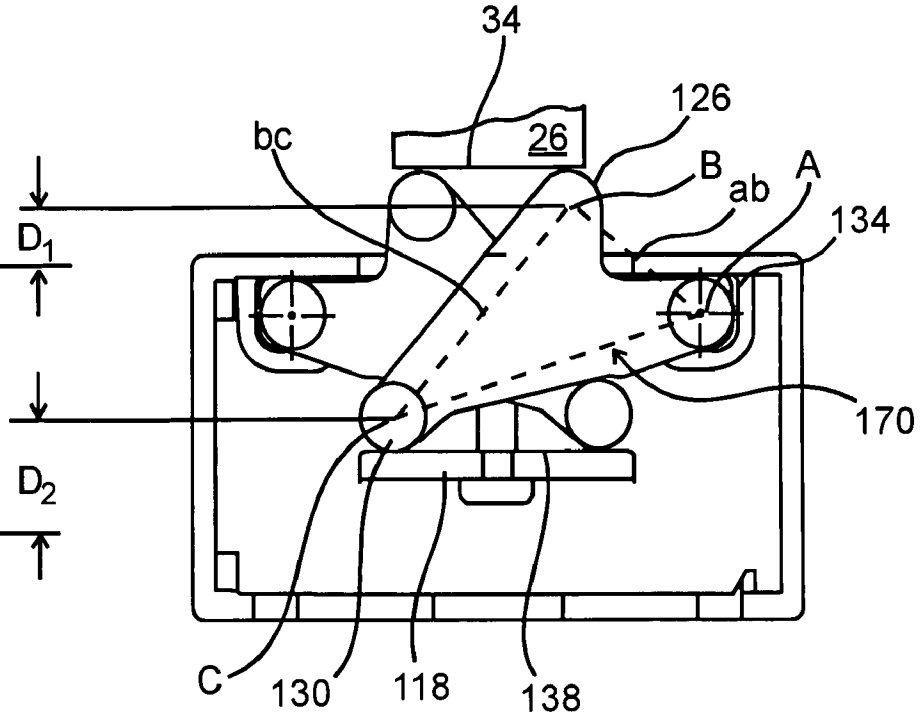
FIGS. 8A and 8B illustrate the operation of the stroke compensator embodiment of FIG. 7.
Figure 8B:
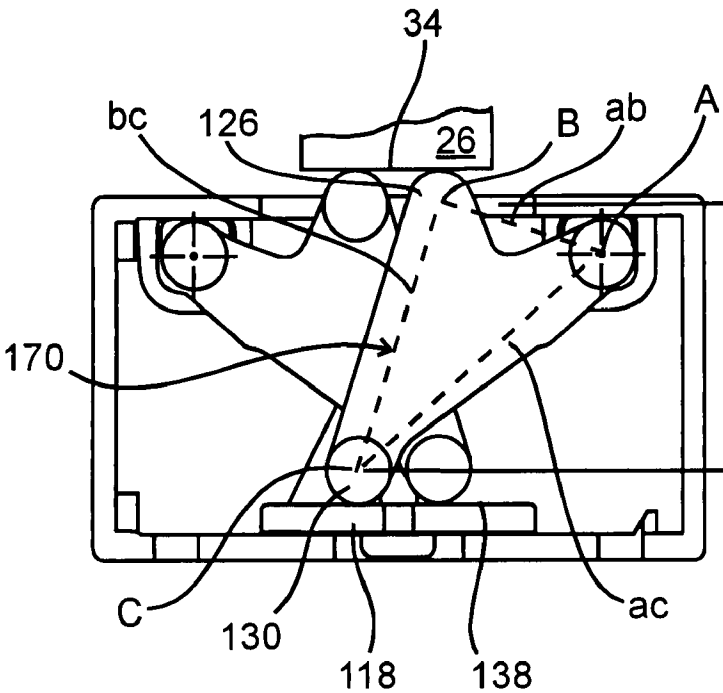

FIG. 7 illustrates in exploded view the stroke compensator 98 of FIGS. 6A and 6B. The housing 102 substantially encloses and moveably supports at least one compensator cam 114 and at least one output plate 118. The compensator cam 114 is pivotably supported by the housing 102 and the output plate 118 is slidably supported by the housing 102. The compensator cam 114 includes a pivot pin 122, an input round 126 and an output round 130. The pivot pin 122 is received in a pocket 134, intergrally formed in the housing 102, for pivotal movement therein. The input round 126 slidably engages the output end 34 of the operating shaft 26, as the input device 10 is operated. This slidable engagement between the output end 34 of the operating shaft 26 and the input round 126 causes the compensator cam 114 to pivot about its pivot pin 122, from an unactivated or first position as shown in FIG. 8*a* to an activated or second position as shown in FIG. 8B. The output plate 118 has a flat surface 138, which is slidably engaged by the output round 130 of the compensator cam 114. The input and output rounds, 126 and 130, respectively, define a radius suitable for slidable engagement with the output end 34 of operating shaft 26 and the flat surface 138 of the output plate 118. The output plate 118 also includes two generally parallel slides 142, each extending outwardly from, and being spaced apart by the flat surface 138. The slides 142 each have an outside surface 146, which defines an outwardly extending ridge 150. The ridges 150 are slidably received in slots 154 defined on opposed inside surfaces 158 of the housing 102. The ridges 150 maintain a generally parallel relationship between the flat surface 138 and the second end 110 of housing 102, as the output plate 118 moves linearly inside housing 102 in response to pivotal movement of the compensator cam 114 between its first and second positions. As the compensator cam 114 pivots about its pivot pin 122, the output round 130 causes the output plate 118 to slidably move toward the second end 110 of the housing 102. The second end 110 of the housing 102 defines at least one aperture 162 for receiving the operating shaft 54 of the output device 14. An output surface 166 of the output plate 118 engages the operating end 74 of the operating shaft 54 of output device 14. As the compensator cam 114 is rotated between its first and second positions, in response to linear movement of the operating shaft 26 of input device 10 between its first and second positions, the output plate 118 causes the operating shaft 54 of the output device 14 to be moved linearly between its first and second positions.

Referring now to FIGS. 8A and 8B, the operation of the compensator cam 114 will be explained in detail. The centers A, B and C, of the pivot pin 122, input round 126 and output round 130, respectively, of the compensator cam 114 form a triangle 170, shown in dashed lines. The length of leg ab of triangle 170 is selected such that the input round 126 can move vertically (linearly) the known or measured stroke distance $D_1$ of the input device 10, without disengaging from the output end 34 of operating shaft 26, as the compensator cam 114 is rotated between its first and second positions. The length of leg ac of triangle 170 is selected such that the output round 130 can move vertically (linearly) the known or measured stroke distance $D_2$, required for properly operating the output device 14, without disengaging the flat surface 138 of output plate 118, as the compensator cam 114 is rotated between its first and second positions. Because of friction between sliding parts, the length of leg ac should also be selected such that the angle between leg bc and the flat surface 138 of operating plate 118 does not significantly approach 90° as the compensator cam 114 is rotated to its second position. This angle is related to the coefficient of friction of the materials of the compensator cam 114 and the operating plate 118, or other component with which the output round 130 is slidably engaged. Generally, when the angle between leg bc of triangle 170 and the flat surface 138 of the operating plate 118 exceeds 70°, the possibility of a condition in which the compensator cam 114 does not return to its first position increases. It is to be understood that limitations in the physical size of the housing 102 can restrict the placement of the pivot pockets 134 and the lengths of the legs ab, ac and bc of triangle 170. It is also to be understood that the three dimensional physical shape of the compensating cam 114 can be altered to accommodate various configurations and restrictions of the housing 102 as long as a triangular configuration between the pivot pin 122, input round 126 and output round 130 is maintained. In some applications the operating plate 118 is not required, therefore the operating round 130 would directly engage the operating end 74 of the output device operating shaft 54 in generally the same manner as the input round 126 engages the operating end 34 of the input device operating shaft 26.

Figure 9:
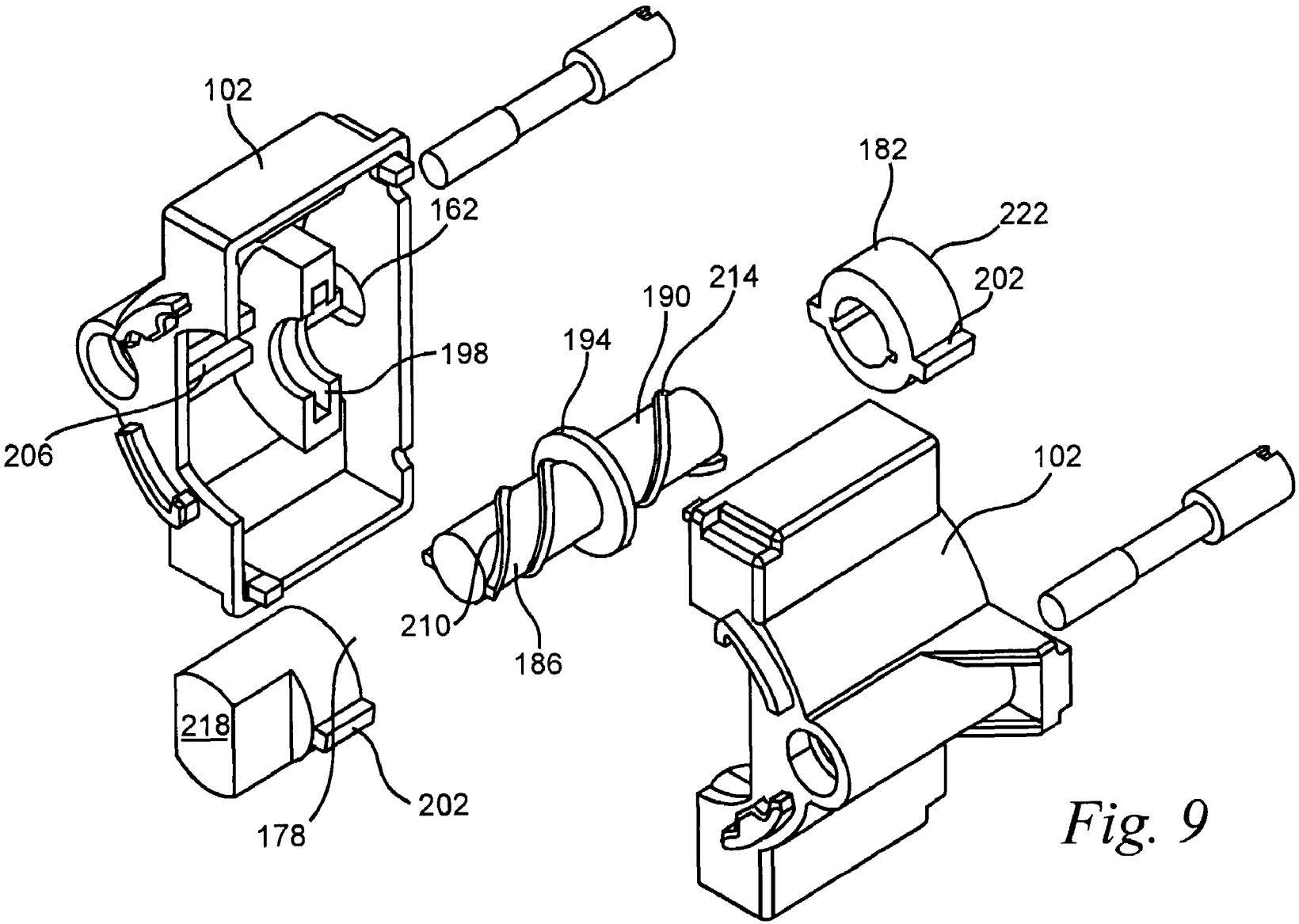
FIG. 9 illustrates an exploded view of a second embodiment of the stroke adapter manufactured in accordance with the present invention.

FIG. 9 is an exploded view illustrating the stroke compensator housing 102 and a second embodiment of the invention. In this embodiment, a compensating screw 174, an input nut 178 and an output nut 182 are employed. For the purpose of this discussion the term "threads" will be defined as any combination of conventional screw threads or grooves and ribs, ramps, nubs or similar projections, which can be configured to provide a spiral rotation between the compensating screw 174 and the input nut 178 or output nut 182. The compensating screw 174 has an input end 186, which threadably receives the input nut 178, an output end 190, which threadably receives the output nut 182 and a central flange 194. The central flange 194 is captivated in a bearing pocket 198 formed in the housing 102. The bearing pocket 198 permits the compensating screw 174 to rotate within the housing 102, but prohibits linear movement. The input and output nuts, 178 and 182, respectively, each have ridges 202, which are slidably received in groves 106 formed in the housing 102. The ridges 202 permit linear movement within the housing 102, but prohibit rotational movement with respect to the housing 102.

The number of threads per inch or rate of twist of both the input end 186 and the output end 190 of the compensating screw 174 is such that a linear motion applied to either the input nut 178 or the output nut 182 will cause the compensating screw 174 to rotate easily about its axis. The rate of twist of the threads 210 of the input end 186 and its associated input nut 178 are selected such that the compensating screw 174 will be rotated a particular angle θ when a linear motion equal to stroke $D_1$ of the input device 10 is applied to an input end 218 of the input nut 178. The rate of twist of the threads 214 of the output end 190 and its associated output nut 182 are selected such that an output end 222 of the output nut 182 will move a linear distance equal to stroke $D_2$ of the output device 14 in response to the compensating screw 174 rotating the particular angle θ. The input end 218 of the input nut 178 is configured for engaging the output end 34 of the input device operating shaft 26 and the output end 222 of the output nut 182 is configured for engaging the input end 74 of the output device operating shaft 54 through apertures 162 provided in the housing 102.

We claim:

1. A linear motion compensator comprising:

a housing defining a generally hollow interior, said housing being adapted for operably connecting to an input device at a first end and to an output device at a second end, and;

a stroke compensator substantially contained within and movably supported by said housing, said stroke compensator receiving a first particular length of linear motion from said input device and transmitting to said output device a second particular length of linear motion, wherein said first and second particular lengths of linear motion are not equal.

2. The linear motion compensator of claim 1, wherein said stroke compensator is at least one compensator cam having a pivot pin pivotably supported by said housing.

3. The linear motion compensator of claim 2, wherein said stroke compensator cam further includes an input round for receiving; said first particular length of linear motion from said input device and an output round for transmitting said second particular length of linear motion to said output device.

4. The linear motion compensator of claim 3, wherein said pivot pin, said input round and said output round define a triangular relationship.

5. The linear motion compensator of claim 4, wherein said triangular relationship includes a first leg connecting said pivot pin and said input round, a second leg connecting said pivot pin and said output round and a third leg connecting said input round and said output round.

6. The linear motion compensator of claim 5, wherein a length for said first leg of said triangle is selected from lengths that permit said input round to move linearly said first particular length of linear motion without disengaging from an operating shalt of said input device.

7. The linear motion compensator of claim 5, wherein a length for said second leg of said triangle is selected from lengths that permit said output round to move linearly said second particular length of linear motion without disengaging from an operating shaft of said output device.

8. The linear motion compensator of claim 5, wherein a length for said second leg of said triangle is selected from lengths that permit said output round to move linearly said second particular length of linear motion without permitting said third leg of said triangle to significantly approach 90° with respect to an operating end of an operating shaft of said output device.

9. The linear motion compensator of claim 5, wherein a length for said second leg of said triangle is selected from lengths that permit said output round to move linearly said second particular length of linear motion without permitting said third leg of said triangle to significantly approach 90° with respect to a flat surface of an operating plate movably supported by said housing for linear movement within said housing.

10. The linear motion compensator of claim 1, wherein said stroke compensator includes:

a compensator screw defining an input end, an output end and a central flange rotatably supported by said housing such that said compensator screw can revolve about its axis but can not move linearly with said housing;

an input nut slidably retained in said housing such that only linear movement with respect to said compensator screw is permitted; and, an output nut, slidably retained in said housing such that only linear movement with respect to said compensator screw is permitted.

11. The linear motion compensator of claim 10, wherein said input nut and said input end of said compensator screw have threads configured to cause said compensator screw to rotate about its axis a particular angle as said input nut is linearly displaced along said input end of said compensator screw by said first particular length of linear motion produced by said operator input device.

12. The linear motion compensator of claim 11, wherein said output nut and said output end of said compensator screw have threads configured to cause said output nut to be linearly displaced along said output end of said compensator screw by said second particular length of linear motion, as said compensator screw is rotated about its axis said particular angle.

13. A linear motion compensator comprising:

a housing defining a generally hollow interior, said housing being adapted for operably connecting to an operator interface device at a first end and to an electrical switching device at a second end, said operator interface device being capable of producing a first particular length of linear movement and said switching device requiring a second particular length linear movement for proper operation, said first and second particular lengths of linear movement not being equal, and;

a stroke compensator substantially contained within and moveably supported by said housing, said stroke compensator converting said first particular length of linear movement to said second particular length of linear movement.

14. The linear motion compensator of claim 13, wherein said stroke compensator is at least one compensator cam having a pivot pin pivotably supported by said housing, an input round for receiving said first particular length of linear movement from said operator interface device and an output round for transmitting said second particular length of linear movement to said switching device.

15. The linear motion compensator of claim 14, wherein a pivotal triangular relationship between said pivot pin, said input round and said output round translates said first particular length of linear movement received by said input round from said operator interface device into said second particular length of linear movement transmitted to said switching device by said output round.

16. The linear motion compensator of claim 13, wherein said stroke compensator includes a compensator screw, an input nut and an output nut.

17. The linear motion compensator of claim 16, wherein said compensator screw defines an input end, an output end and a central flange rotatably supported by said housing such that said compensator screw can revolve about its axis but can not move linearly with said housing.

18. The linear motion compensator of claim 17, wherein said input nut and said output nut are slidably retained in said housing such that only linear movement with respect to said compensator screw is permitted.

19. The linear motion compensator of claim 18, wherein said input nut and said input end of said compensator screw have threads configured to cause said compensator screw to rotate about its axis a particular angle as said input nut is displaced by said first particular length of linear movement produced by said operator interface device.

20. The linear motion compensator of claim 19, wherein said output nut and said output end of said compensator screw have threads configured to cause said output nut to be linearly displaced along said output end of said compensator screw, by said second particular length of linear movement required for proper operation of said switching device, as said compensator screw is rotated about its axis said particular angle.

* * * * *